United States Patent [19]

Takeshige et al.

[11] 4,440,584

[45] Apr. 3, 1984

[54] METHOD AND APPARATUS FOR COOLING STEEL SHEET

[75] Inventors: Kenji Takeshige; Kenji Hirabe; Yukifumi Ogawa; Kazuyoshi Arikata; Kazunori Yako, all of Fukuyama; Kenichi Sakai, Kasaoka; Toshinori Matsuo, Fukuyama; Hiroshi Kamio, Yokohama, all of Japan

[73] Assignee: Nippon Kokan Kabushiki Kaisha, Tokyo, Japan

[21] Appl. No.: 406,932

[22] Filed: Aug. 10, 1982

[30] Foreign Application Priority Data

Aug. 21, 1981 [JP] Japan ..... 56-130222

[51] Int. Cl.[3] ..... C21D 1/647; C21D 9/573

[52] U.S. Cl. ..... 148/128; 266/80; 266/114; 266/134; 72/201; 148/155; 148/157

[58] Field of Search ..... 266/113, 111-112, 266/114, 117, 115, 134, 87, 89, 90, 80, 78, 45; 72/201; 148/128, 155, 157, 126

[56] References Cited

U.S. PATENT DOCUMENTS 2,211,981 8/1940 McBain et al. ..... 72/201

FOREIGN PATENT DOCUMENTS 2652211 5/1978 Fed. Rep. of Germany ..... 72/201
56-74301 6/1981 Japan ..... 72/201

*Primary Examiner*—L. DeWayne Rutledge
*Assistant Examiner*—Christopher W. Brody
*Attorney, Agent, or Firm*—Frishauf, Holtz, Goodman & Woodward

[57] ABSTRACT

A method and an apparatus for cooling a steel sheet, which comprises: ejecting cooling water onto a steel sheet laid horizontally from above and from below said steel sheet immediately after the completion of hot rolling to cool said steel sheet; shielding each of the both side edge portions of the upper surface in the width direction of said steel sheet from said ejected cooling water by a shielding means movable in the width direction of said steel sheet so that the temperature distribution in the width direction of said steel sheet becomes uniform at the completion of the ejection of cooling water; and, determining a shielding width of each of said both side edge portions of said steel sheet, which is shielded from said ejected cooling water, on the basis of the width and the thickness of said steel sheet, the temperature and the flow rate per unit area of cooling water ejected onto the upper and the lower surfaces of said steel sheet, the period of time from start to completion of the ejection of cooling water, and the temperature distribution in the width direction of said steel sheet immediately before the start of the ejection of cooling water.

11 Claims, 21 Drawing Figures

METHOD AND APPARATUS FOR COOLING STEEL SHEET

FIELD OF THE INVENTION

The present invention relates to a method and an apparatus for cooling a steel sheet, which permits cooling of a steel sheet immediately after the completion of hot rolling so that the temperature distribution in the width direction of said steel sheet becomes uniform at the completion of cooling.

BACKGROUND OF THE INVENTION

It is the conventional practice to apply heat treatment to a hot-rolled steel sheet for the purpose of improving strength, toughness and other properties of the hot-rolled steel sheet. In most cases, such a heat treatment is applied to the hot-rolled steel sheet allowed to spontaneously cool after the completion of hot rolling. However, since such a heat treatment is very low in efficiency, apparatus have recently been developed, which cool a steel sheet immediately after the completion of hot rolling before the temperature of the steel sheet lowers to below a prescribed value, thereby improving strength, toughness and other properties thereof.

As one of the apparatus as mentioned above for cooling a steel sheet immediately after the completion of hot rolling, the following apparatus has been proposed, as disclosed in Japanese Patent Publication No. 11,247/78 dated Apr. 20, 1978, which comprises:

a plurality of upper and lower support/guide rollers each arranged symmetrically relative to the plane of a steel sheet laid horizontally; and a covering including a substantially flat wall arranged between two adjacent rollers on each side of the steel sheet and a wall surrounding said two adjacent rollers, said covering being closed at the both ends and the both side edges thereof, and a plurality of cooling water supply pipes and a plurality of cooling water discharge pipes being alternately connected to said wall surrounding said two adjacent rollers, thereby cooling the steel sheet through contact of the upper and the lower surfaces of the steel sheet with cooling water in said covering.

A steel sheet immediately after the completion of hot rolling can be cooled by the above-mentioned apparatus which has however the following disadvantages:

1. Since cooling water flows in the covering which provides only a limited space, it is difficult to control the cooling rate.
2. Necessity to cool the steel sheet by cooling water while moving the steel sheet makes it impossible to start cooling the entire steel sheet at a time. Therefore, the cooling start temperature cannot be the same between the leading end and the trailing end in the longitudinal direction of the steel sheet.

With these disadvantages in view, another apparatus has been developed, as disclosed in Japanese Utility Model Publication No. 28,194/81 dated July 4, 1981, which permits starting of cooling of a steel sheet at a time under easy control of the cooling rate, and cools the steel sheet by cooling water ejected from cooling nozzles, which comprises:

a table comprising a plurality of rollers for placing thereon substantially horizontally a steel sheet immediately after the completion of hot rolling; and a plurality of upper cooling nozzle units and a plurality of lower cooling nozzle units respectively arranged, at prescribed intervals in the longitudinal direction of said steel sheet placed on said table, above and below said steel sheet, each of said cooling nozzle units having substantially the same length as the width of said steel sheet, each of said cooling nozzle units being arranged in parallel with the width direction of said steel sheet, and said plurality of upper cooling nozzle units and said plurality of lower cooling nozzle units being adapted to eject cooling water respectively onto the upper and the lower surfaces of said steel sheet.

With the above-mentioned apparatus equipped with the cooling nozzle units, it is possible:

1. to easily control the cooling rate, since cooling water from the cooling nozzle units is not subjected to any constraint; and,
2. to cool at a time the entire steel sheet placed on the table.

According to the above-mentioned apparatus equipped with the cooling nozzle units, it is possible to cool a steel sheet immediately after the completion of hot rolling, which has an average surface temperature of 600° to 900° C., for example, to a temperature up to 550° C. at a cooling rate of, for example, 3° to 15° C./sec.

In general, however, the temperature distribution in the width direction of a steel sheet immediately after the completion of hot rolling is not uniform. More particularly, as shown in FIG. 1(*a*), the temperature of a steel sheet immediately after the completion of hot rolling is lower at the side edge portions in the width direction than at the center portion thereof. Therefore, when cooling a steel sheet immediately after the completion of hot rolling by an apparatus equipped with the cooling nozzle units as mentioned above, the difference in temperature between the side edge portions and the center portion in the width direction of the steel sheet immediately after the completion of cooling would further be enlarged as shown in FIG. 1(*b*) for the following reasons:

1. Cooling water from the upper cooling nozzle units, which is ejected onto the upper surface of the steel sheet flows down from the both side edges of the steel sheet. When considering the steel sheet in the width direction thereof, therefore, the side edge portions are cooled more strongly than the center portion.
2. Because of the complicated heat conduction mechanism shown by water cooling in the high temperature region, the side edge portions are cooled more strongly than the center portion in the width direction of the steel sheet.

In the steel sheet thus cooled, therefore, there is a serious deviation in mechanical properties such as tensile strength in the width direction and the entire steel sheet demonstrates an insufficient flatness as a whole. An example of an average surface hardness distribution in the width direction of a steel sheet thus cooled and then allowed to spontaneously cool is shown in FIG. 1(*c*).

SUMMARY OF THE INVENTION

A principal object of the present invention is therefore to provide a method and an apparatus for cooling a steel sheet, which permit cooling of the steel sheet immediately after the completion of hot rolling so that a uniform temperature distribution in the width direction is available at the completion of cooling.

In accordance with one of the features of the present invention, there is provided: in a method for cooling a steel sheet, which comprises:

ejecting cooling water onto a steel sheet laid horizontally from above and from below said steel sheet immediately after the completion of hot rolling to cool said steel sheet;

the improvement characterized by:

shielding each of the both side edge portions of the upper surface in the width direction of said steel sheet from said ejected cooling water by a shielding means movable in the width direction of said steel sheet so that the temperature distribution in the width direction of said steel sheet becomes uniform at the completion of the ejection of cooling water; and, determining a shielding width of each of said both side edge portions of said steel sheet, which is shielded from said ejected cooling water, on the basis of the width and the thickness of said steel sheet, the temperature and the flow rate per unit area of cooling water ejected onto the upper and the lower surfaces of said steel sheet, the period of time from start to completion of the ejection of cooling water, and the temperature distribution in the width direction of said steel sheet immediately before the start of the ejection of cooling water.

BRIEF DESCRIPTION OF THE DRAWINGS

FIG. 1(*b*) is a drawing illustrating an example of an average temperature distribution in the width direction of a steel sheet immediately after the completion of cooling;

FIG. 1(*c*) is a drawing illustrating an example of a surface hardness distribution in the width direction of a steel sheet after spontaneous cooling;

FIG. 2(*b*) is a drawing illustrating an embodiment of cooling positions of a steel sheet placed in the cooling apparatus of the present invention;

FIG. 10(*b*) is a drawing illustrating an example of calculated result of temperature distributions of the upper and the lower surfaces in the width direction of a steel sheet at the completion of the ejection of cooling water;

FIG. 12(*b*) is a drawing illustrating an example of an average temperature distribution in the width direction of a steel sheet at the completion of the ejection of cooling water;

FIG. 12(*c*) is a drawing illustrating an example of an average surface hardness distribution in the width direction of a steel sheet after spontaneous cooling;

FIG. 13(*b*) is a drawing illustrating an example of an average temperature distribution in the width direction of a steel sheet at the completion of the ejection of cooling water; and, FIG. 13(*c*) is a drawing illustrating an example of an average surface hardness distribution in the width direction of a steel sheet after spontaneous cooling.

DETAILED DESCRIPTION OF THE PREFERRED EMBODIMENTS

With a view to solving the above-mentioned problems involved in the cooling apparatus of a steel sheet equipped with the cooling nozzle units, we carried out extensive studies. As a result, we obtained the following findings:

1. By ejecting cooling water onto the upper and the lower surfaces of a steel sheet immediately after the completion of hot rolling while shielding the both side edge portions of the upper surface in the width direction of the steel sheet from cooling water ejected from the upper cooling nozzle units, the center portion of the steel sheet is cooled more strongly than the side edge portions. It is therefore possible to achieve a substantially uniform temperature distribution in the width direction of the steel sheet at the completion of the ejection of cooling water.
2. The both side edge portions of the upper surface in the width direction of the steel sheet can be adjustably shielded from cooling water ejected from the upper cooling nozzle units by using a shielding means movable in the width direction of the steel sheet placed on the table.
3. The shielding width at each of the both side edge portions in the width direction of the steel sheet shielded from the ejected cooling water, which gives a substantially uniform temperature distribution in the width direction of the steel sheet at the completion of the ejection of cooling water, can be calculated on the basis of the width and the thickness of the steel sheet, the temperature of cooling water, the flow rate per unit area of cooling water ejected from the upper and the lower cooling nozzle units onto the upper and the lower surfaces of the steel sheet, the period of time from start to completion of the ejection of cooling water, and the temperature distribution in the width direction of the steel sheet immediately before the start of the ejection of cooling water.

The present invention was developed on the basis of the above-mentioned findings (1 to 3). The method and the apparatus for cooling a steel sheet of the present invention are described below in detail with reference to the drawings.

Figure 1:
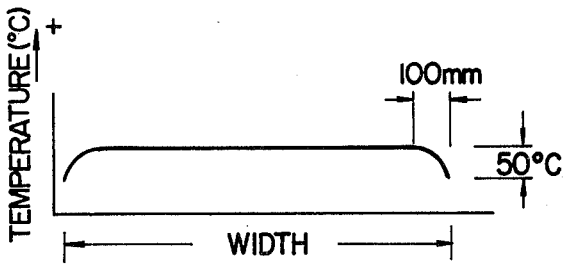
FIG. 1(*a*) is a drawing illustrating an example of an average temperature distribution in the width direction of a steel sheet immediately after the completion of hot rolling.
Figure 1:
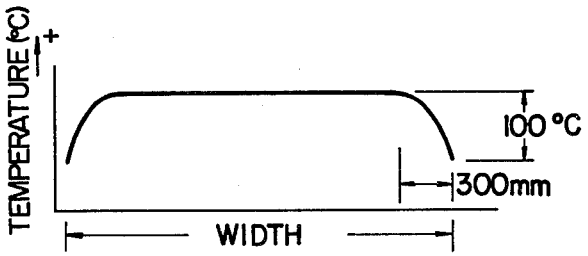
Figure 1:
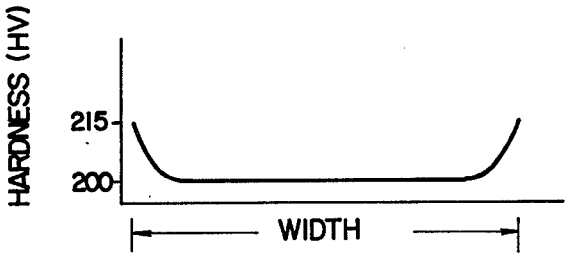
Figure 2:
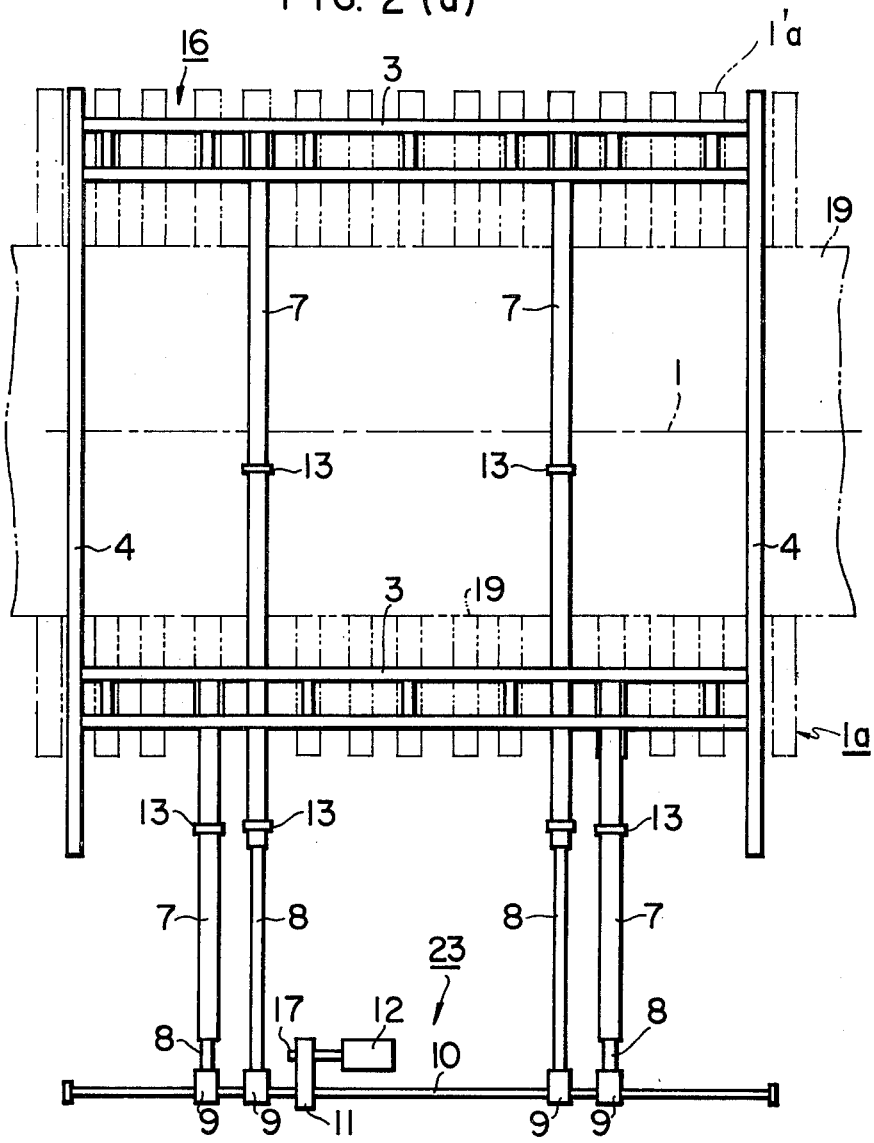
FIG. 2(*a*) is a schematic plan view illustrating an embodiment of a portion of the cooling apparatus of the present invention.
Figure 2:
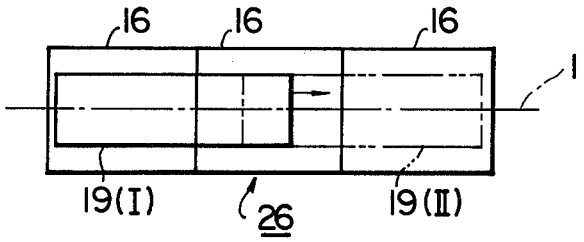

FIG. 2(*a*) is a schematic plan view illustrating an embodiment of a part of the cooling apparatus of the present invention. As shown in FIG. 2(*b*), the cooling apparatus 26 of the present invention has a large size enough for receiving an entire steel sheet 19 immediately after the completion of hot rolling. As shown in FIG. 2(*a*), the cooling apparatus 26 of the present invention has a table 1*a* comprising a plurality of rollers 1'*a* arranged on the same horizontal plane in the downstream of the conventional hot rolling facilities (not shown). The cooling apparatus 26 of the present invention has a plurality of upper cooling nozzle units and a plurality of lower cooling nozzle units, as described later, arranged respectively above and below the steel sheet 19 laid horizontally on the table 1*a*. As shown in FIG. 2(*b*), the cooling apparatus 26 of the present invention comprises a plurality of cooling blocks 16 arranged along the center line 1 of the cooling apparatus 26. One of these cooling blocks 16 is represented in FIG. 2(*a*). The steel sheet 19 immediately after the completion of hot rolling travels on the table 1*a* and is completely received in the cooling apparatus 26 of the present invention, as shown by the position (I) in FIG. 2(*b*). While the steel sheet 19 thus received in the cooling apparatus 26 travels from the position (I) to the position (II) in the cooling apparatus 26, cooling water is ejected from the plurality of upper cooling nozzle units and the plurality of lower cooling nozzle units onto the entire upper and lower surfaces of the steel sheet 19, whereby the steel sheet 19 is cooled.

Figure 3:
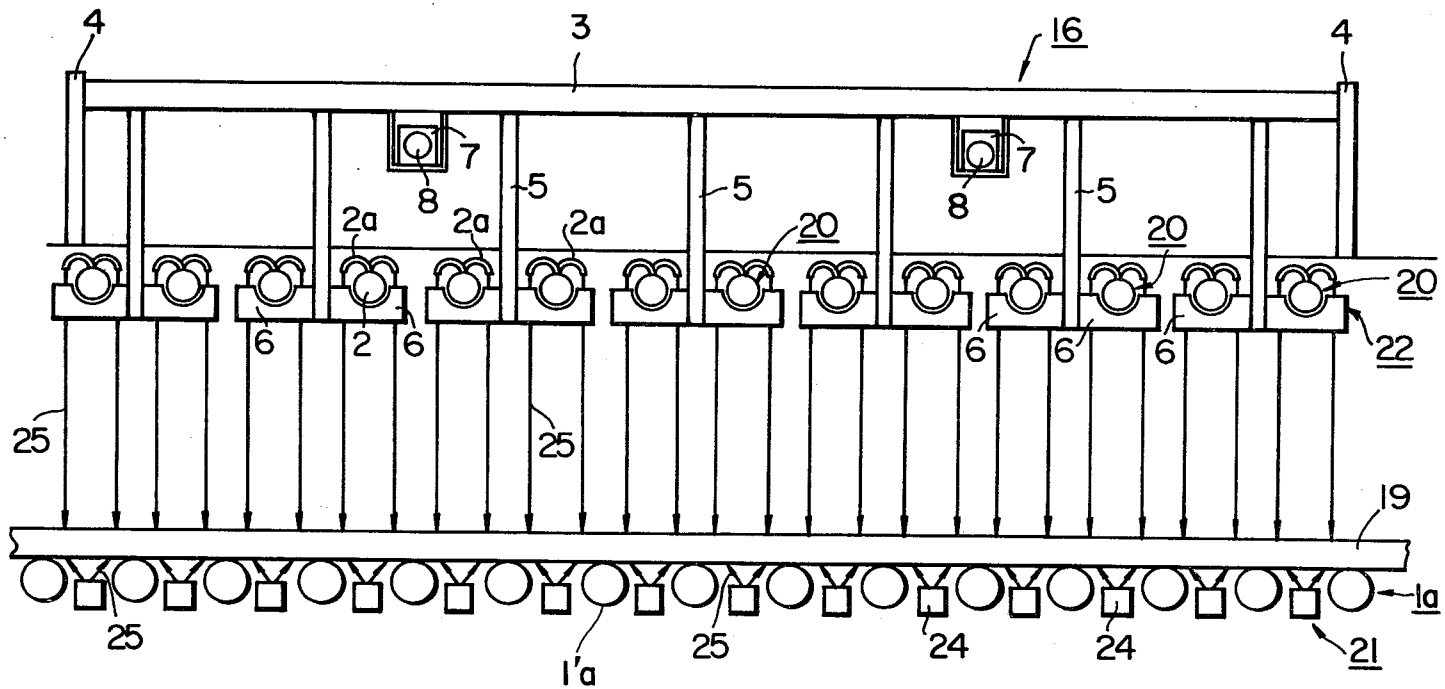
FIG. 3 is a schematic front view illustrating an embodiment of one cooling block of the cooling apparatus of the present invention.

FIG. 3 illustrates one of the cooling blocks 16 of the cooling apparatus 26 of the present invention. In FIG. 3, 20 are the plurality of upper cooling nozzle units arranged at prescribed intervals in the longitudinal direction of the steel sheet 19 placed on the table 1*a*, above the steel sheet 19, and 21 are the plurality of lower cooling nozzle units arranged at prescribed intervals in the longitudinal direction of the steel sheet 19 below the steel sheet 19. Each of the cooling nozzle units 20 and 21 has substantially the same length as the width of the steel sheet 19, and is arranged in parallel with the width direction of the steel sheet 19. The plurality of upper cooling nozzle units 20 and the plurality of lower cooling nozzle units 21 are adapted to eject cooling water respectively onto the upper and the lower surfaces of the steel sheet 19. Therefore, the steel sheet 19 is cooled by cooling water ejected from the cooling nozzle units 20 and 21 while travelling on the table 1*a*.

As shown in FIG. 3, each of the upper cooling nozzle units 20 comprises a nozzle header 2 and a plurality of nozzles 2*a* installed at the top of the nozzle header 2 at prescribed intervals in the longitudinal direction of the header 2. Openings of the plurality of nozzles 2*a* are arranged alternately and downwardly on the both sides of the nozzle header 2, and the nozzles 2*a* eject cooling water vertically downward. Each of the lower cooling nozzle units 21 comprises a nozzle header 24 and a plurality of nozzles installed at the top of the header 24 at prescribed intervals in the longitudinal direction of the nozzle header 24. The nozzles installed on the nozzle header 24 open upwardly and eject cooling water upward.

Figure 4:
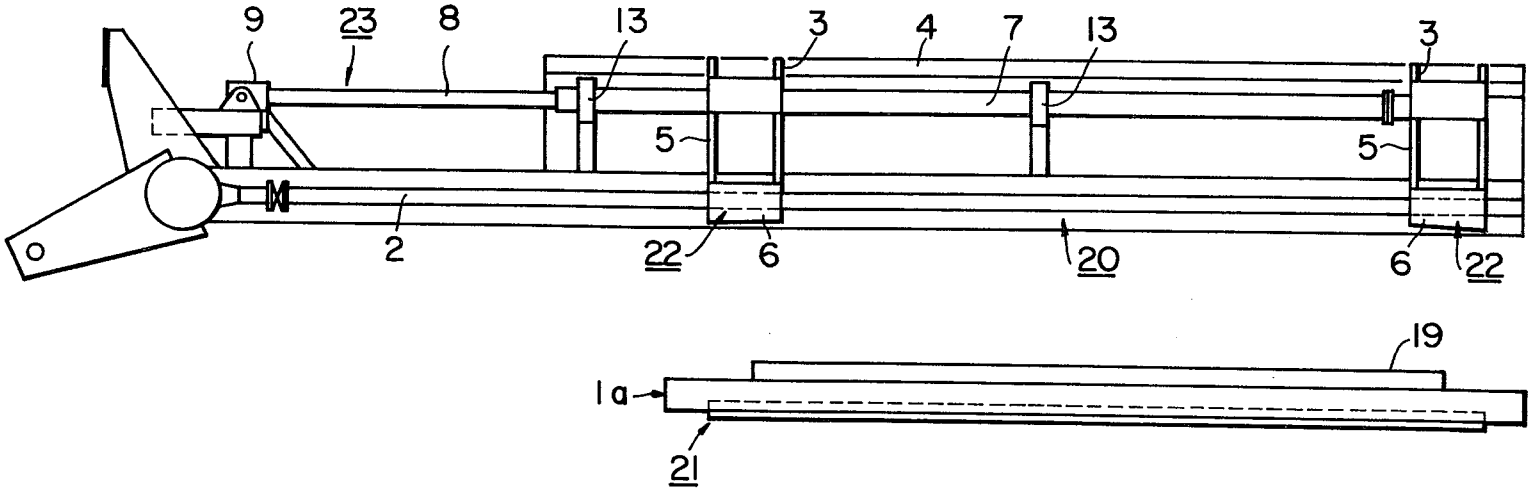
FIG. 4 is a schematic side view illustrating an embodiment of one cooling block of the cooling apparatus of the present invention.

In FIGS. 3 and 4, 22 are shielding means movable in the width direction of the steel sheet 19, arranged at each of the both side edge portions in the width direction of the steel sheet 19, between the upper cooling nozzle units 20 and the steel sheet 19 placed on the table 1*a*. The shielding means 22 are adapted to shield the both side edge portions of the upper surface of the steel sheet 19 from cooling water ejected from the upper cooling nozzle units 20. In FIG. 4, 23 is a moving means for moving the shielding means 22 in the width direction of the steel sheet 19. The moving means 23 has a pair of supporting frames 3. Each of the shielding means 22 comprises a plurality of shielding units 6 arranged for each of the upper cooling nozzle units 20 so as to be adjacent to the bottom of each of the upper cooling nozzle units 20. Each of the shielding units 6 for each of the shielding means 22 is supported on each of the pair of supporting frames 3 through a supporting arm 5.

Figure 5:
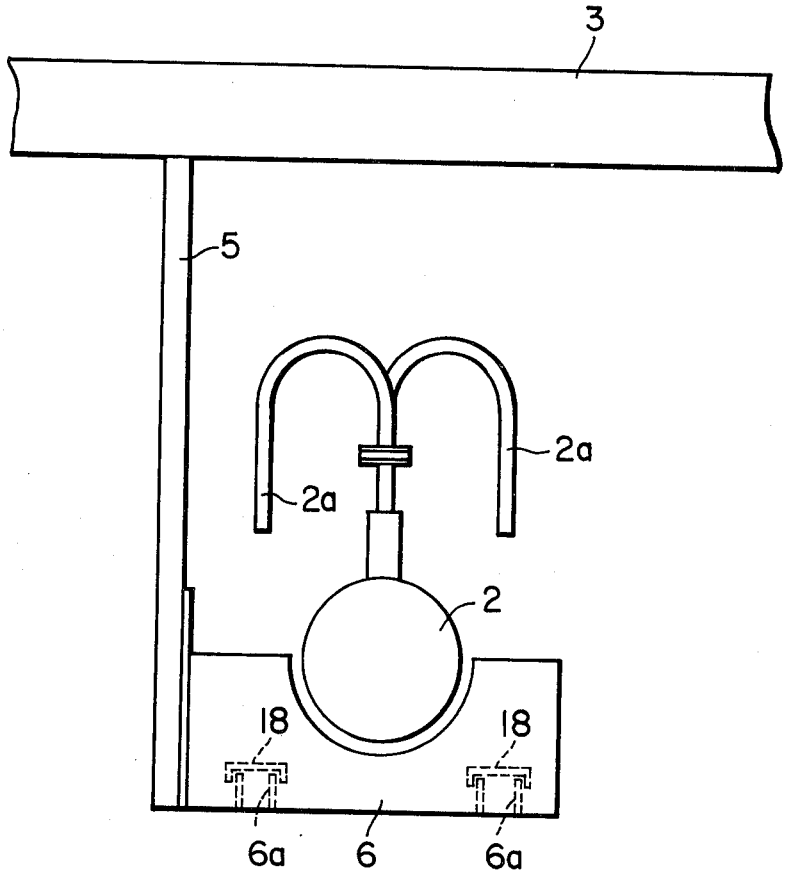
FIG. 5 is a schematic front view illustrating an embodiment of the shielding unit of the present invention.
Figure 6:
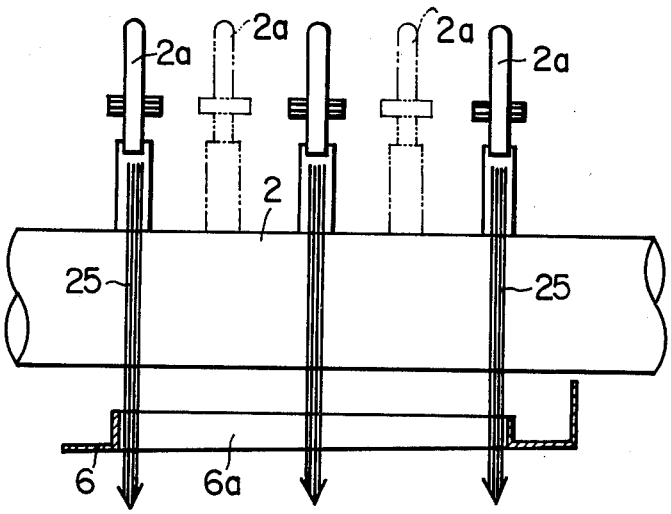
FIG. 6 is a schematic side view illustrating an embodiment of the shielding unit of the present invention, the slit of which is opened.
Figure 7:
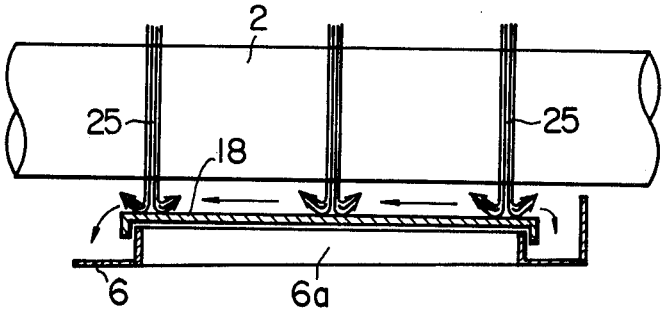
FIG. 7 is a schematic side view illustrating an embodiment of the shielding unit of the present invention, the slit of which is closed.
Figure 9:
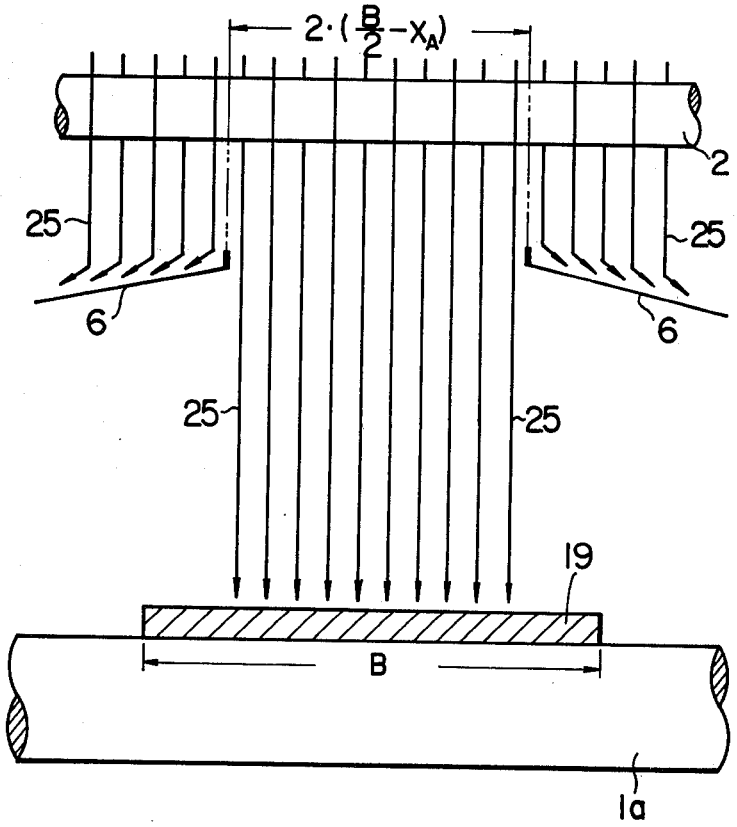
FIG. 9 is a drawing illustrating an embodiment of the ejection of cooling water from the upper cooling nozzle units of the present invention.

As shown in FIG. 4, the bottom of each of the shielding units 6 inclines downwardly from the center of the steel sheet 19 toward the side edge in the width direction thereof. As shown in FIGS. 5, 6 and 7, a pair of slits 6*a* capable of being opened and closed are formed in parallel with the nozzle header 2 at positions allowing passage of cooling water ejected from the nozzles 2*a* on the bottom of each of the shielding units 6. Each of the slit 6*a* is provided with a removable lid 18 for closing the slits 6*a*. When the lid 18 is removed from the slit 6*a*, as shown in FIG. 6, cooling water ejected from the nozzle 2*a* above the shielding unit 6 is ejected through the slit 6*a* onto the side edge portion of the upper surface of the steel sheet 19. On the other hand, when the lid 18 is placed on the slit 6*a*, as shown in FIG. 7, cooling water ejected from the nozzle 2*a* above the shielding unit 6 is intercepted its passage by the lid 18, and is discharged to the outside along the downwardly inclined bottom of the shielding unit 6. Thus the side edge portion of the upper surface in the width direction of the steel sheet 19 is shielded from cooling water ejected from the nozzle 2*a*. An example of this process is shown in FIG. 9.

The shielding rate, "Y", of the shielding means 22 in the longitudinal direction of the steel sheet 19 is expressed as follows:

$$Y = \left(\begin{array}{c}\text{Number of slits 6a}\\ \text{closed by the lids 18}\\ \text{in the shielding means 22}\end{array}\right) \Big/ \left(\begin{array}{c}\text{Total number of slits}\\ \text{6a in the shielding}\\ \text{means}\end{array}\right)$$

Figure 8:
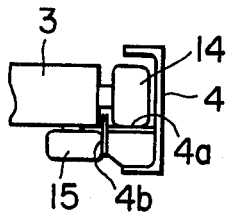
FIG. 8 is a front view illustrating an embodiment of an end in the longitudinal direction of the supporting frame of the present invention.

As shown in FIG. 2, a pair of supporting frames 3 are arranged above the both sides of the table 1*a* in parallel with the center line 1 of the table 1*a*. The both ends of each of the supporting frames 3 are slidably supported by a pair of guide frames 4 provided above the steel sheet 19 placed on the table 1*a* so as to intersect with the center line 1 of the table 1*a* at right angles, whereby the pair of supporting frames 3 are movable in a direction perpendicular to the center line 1, i.e., in the width direction of the steel sheet 19. As shown in FIG. 8, a receiving roller 14 rolling on the horizontal portion 4*a* of a guide frame 4 and a guide roller 15 rolling on the vertical portion 4*b* of the guide frame 4 are fitted to each of the both ends of the supporting frames 3. The supporting frame 3 moves smoothly along the guide frame 4 by the aid of the receiving guides 14, and do not swing in the longitudinal direction by the aid of the guide rollers 15.

As shown in FIG. 2, one end of each of two pipes 7 is fixed to one of the supporting frames 3 so that the pipe 7 intersects with the center line 1 of the table 1*a* at right angles. As shown in FIGS. 2 and 4, each of the pipes 7 is slidably supported by at least one supporting means 13 in the middle of the pipe 7. Threads are formed on the inner wall of the pipe 7, and one end of a screw 8 is driven into the other end of the pipe 7. As shown in FIG. 2, the other ends of four screws 8 are connected to a driving shaft 10 through bevel gear mechanisms 9 so as to rotate in the same direction. The driving shaft 10 is arranged in parallel with the center line 1 of the table 1*a* and connected to a motor 12 through a reduction gear 11. The threads of the two screws 8 driven into the two pipes 7 fixed to the one supporting frame 3 run in the reverse direction to that of the threads of the two screws 8 driven into the two pipes 7 fixed to the other supporting frame 3. Therefore, by driving the motor 12, the four screws 8 rotate in the same direction through the reduction gear 11, the driving shaft 10 and the bevel gear mechanisms 9, and the pair of supporting frames 3 move closer to each other and apart from each other by the same distance depending upon the revolutions of the motor 12. Thus, the shielding units 6 supported by the supporting frames 3 move in the width direction of the steel sheet 19, i.e., in the longitudinal direction of the nozzle headers 2, depending upon the revolutions of the motor 12.

As shown in FIG. 9, the shielding width of each of the both side edge portions in the width direction of the steel sheet 19, which is shielded by the shielding unit 6 from cooling water 25 ejected from the nozzles 2*a* (not shown) may be altered by moving the shielding unit 6 in the width direction of the steel sheet 19 by driving the motor 12. In FIG. 9, "B" represents the width of the steel sheet 19, and "$X_A$", the shielding width. The position of the shielding unit 6 in the width direction of the steel sheet 19 placed on the table 1*a* is detected by a pulse generator 17 connected to the reduction gear 11, as shown in FIG. 2. The position of the shielding unit 6 in the width direction of the steel sheet 19 is controlled by controlling the revolution of the motor 12 with the use of an appropriate controlling means (not shown) on the basis of a signal from the pulse generator 17, thereby controlling the shielding width.

Figure 10:
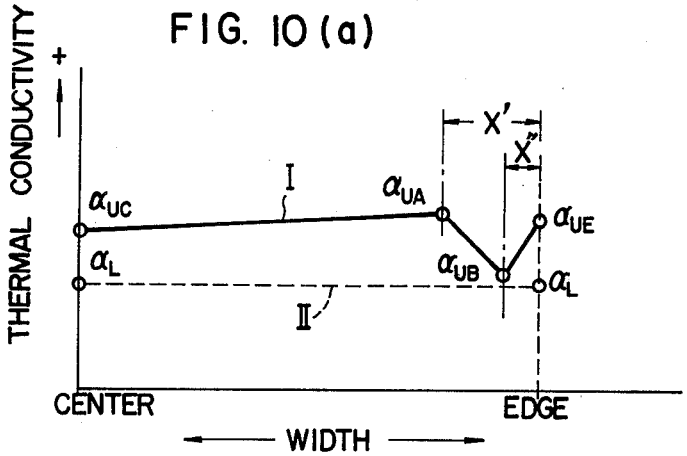
FIG. 10(*a*) is a drawing illustrating an example of calculated result of an average thermal conductivity distribution of the upper and the lower surfaces in the width direction of a steel sheet for the period of time from start to completion of the ejection of cooling water.
Figure 10:
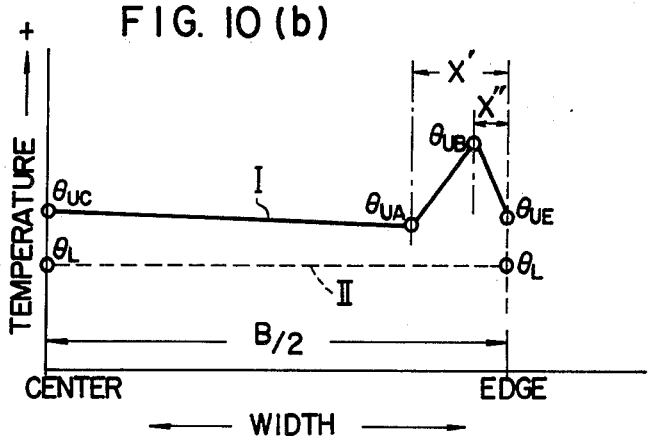

The shielding width is determined as follows prior to the start of the ejection of cooling water from the cooling nozzle units 20 and 21:

a. calculating an average thermal conductivity distribution of each of the upper and the lower surfaces in the width direction of the steel sheet 19 at the longitudinal center thereof during the period of time from start to completion of the ejection of cooling water, in accordance with the following empirical formulae (1) to (8) (as determined at a shielding ratio of 50%):

$$\alpha_{UC}=43.16W_U^{0.899} \quad (1)$$

$$\alpha_{UE}=\{(0.2294-0.01W_U-0.99\times10^{-5}W_U^2).^{B}/_{4000}+1\}.\alpha_{UC}\times f_1 \quad (2)$$

$$f_1=X^{\{-0.2849(B/2000)-0.578\}}\times0.7036\times10^{-3}(B/2000)^2+0.15(B/2000)+1.2815 \quad (3)$$

$$\alpha_{UA}=\alpha_{UC}\times\{(0.2294-0.01W_U-0.99\times10^{-5}W_U^2)(B/2-1.99\times^{0.91})/2000+1\} \quad (4)$$

$$\alpha_{UB}=\alpha_{UC}\times15.208W_U^{-0.203}(b/2)^{-0.046}\times^{-0.466} \quad (5)$$

$$\alpha_L=34.7W_L^{0.68} \quad (6)$$

$$X'=1.99\times^{0.91} \quad (7)$$

$$X''=2.21\times^{0.68} \quad (8)$$

where, $\alpha_{UC}$: average thermal conductivity at the center portion of the upper surface in the width direction of the steel sheet 19;

$\alpha_{UE}$: average thermal conductivity at the side edge portions of the upper surface in the width direction of the steel sheet 19;

X': distance between the side edge and the lowest-temperature portion of the upper surface in the width direction of the steel sheet 19;

X'': distance between the side edge and the highest-temperature portion of the upper surface in the width direction of the steel sheet 19;

$\alpha_{UA}$: average thermal conductivity at the lowest-temperature portion of the upper surface in the width direction of the steel sheet 19;

$\alpha_{UB}$: average thermal conductivity at the highest-temperature portion of the upper surface in the width direction of the steel sheet 19;

$\alpha_L$: average thermal conductivity of the lower surface of the steel sheet 19;

$W_U$: flow rate per unit area of cooling water 25 ejected onto the upper surface of the steel sheet 19;

$W_L$: flow rate per unit area of cooling water 25 ejected onto the lower surface of the steel sheet 19;

B: width of the steel sheet 19; and,

X: provisional shielding width.

an example of thus obtained result of calculation is shown in FIG. 10(*a*). In FIG. 10(*a*), "I" represents the average thermal conductivity distribution of the upper surface in the width direction of the steel sheet 19, and "II", that of the lower surface in the width direction of the steel sheet 19.

b. Then, calculating a temperature distribution of each of the upper and the lower surfaces in the width direction of the steel sheet 19 at the longitudinal center thereof at the completion of the ejection of cooling water 25, in accordance with the following empirical formula (9):

$$\theta=\theta_w+(\theta_s-\theta_w)e^{-\left(\frac{\tau-0.009(t/2)^{1.88}}{0.22\{90000t\alpha-1+(t/2)^2\}}\right)} \quad (9)$$

where, $\theta$: $\theta_{UC}$, $\theta_{UE}$, $\theta_{UA}$, $\theta_{UB}$ or $\theta_L$;

$\theta_{UC}$: temperature of the center portion of the upper surface in the width direction of the steel sheet 19 at the completion of the ejection of cooling water 25;

$\theta_{UE}$: temperature of the side edge portions of the upper surface in the width direction of the steel sheet 19 at the completion of the ejection of cooling water 25;

$\theta_{UA}$: temperature of the lowest-temperature portion of the upper surface in the width direction of the steel sheet 19 at the completion of the ejection of cooling water 25;

$\theta_{UB}$: temperature of the highest-temperature portion of the upper surface in the width direction of the steel sheet 19 at the completion of the ejection of cooling water 25;

$\theta_L$: temperature of the center portion of the lower surface in the width direction of the steel sheet 19 at the completion of the ejection of cooling water 25;

$\theta_S$: $\theta_{SUC}$, $\theta_{SUE}$, $\theta_{SUA}$, $\theta_{SUB}$ or $\theta_{SL}$ (as the value of $\theta_X$, a measured value obtained by such a temperature measuring means as a linear array camera, or an estimated value based on measured values of temperature obtained from many steel sheets immediately after the completion of hot rolling may be employed);

$\theta_{SUC}$: temperature of the center portion of the upper surface in the width direction of the steel sheet 19 immediately before the start of the ejection of cooling water 25;

$\theta_{SUE}$: temperature of the side edge portions of the upper surface in the width direction of the steel sheet 19 immediately before the start of the ejection of cooling water 25;

$\theta_{SUA}$: temperature of the lowest-temperature portion of the upper surface in the width direction of the steel sheet 19 immediately before the start of the ejection of cooling water 25;

$\theta_{SUB}$: temperature of the highest-temperature portion of the upper surface in the width direction of the steel sheet 19 immediately before the start of the ejection of cooling water 25;

$\theta_{SL}$: temperature of the center portion of the lower surface in the width direction of the steel sheet 19 immediately before the start of the ejection of cooling water 25;

$\theta_W$: temperature of cooling water 25;

$\tau$: period of time from start to completion of the ejection of cooling water 25;

t : thickness of the steel sheet 19;

$\alpha$: $\alpha_{UC}$, $\alpha_{UE}$, $\alpha$UA, $\alpha_{UB}$ or $\alpha_L$; and, Combinations of $\theta$, $\theta_S$ and $\alpha$ being any one of ($\theta_{UC}$, $\theta_{SUC}$, $\alpha_{UC}$), ($\theta_{UE}$, $\theta_{SUE}$, $\alpha_{UE}$), ($\theta_{UA}$, $\theta_{SUA}$, $\alpha_{UA}$), ($\theta_{UB}$, $\theta_{SUB}$, $\alpha_{UB}$), and ($\theta_L$, $\theta_{SL}$, $\alpha_L$).

An example of thus obtained result of calculation is shown in FIG. 10(*b*). In FIG. 10(*b*), "I" represents the temperature distribution of the upper surface in the width direction of the steel sheet 19, and "II", that of the lower surface in the width direction of the steel sheet 19.

c. Then, calculating an average temperature distribution in the width direction of the steel sheet 19 at the longitudinal center thereof at the completion of the ejection of cooling water 25, in accordance with the following formulae (10) to (13):

$$\theta_C=\tfrac{1}{2}(\theta_{UC}+\theta_L) \quad (10)$$
$$\theta_E=\tfrac{1}{2}(\theta_{UE}+\theta_L) \quad (11)$$
$$\theta_A=\tfrac{1}{2}(\theta_{UA}+\theta_L) \quad (12)$$
$$\theta_B=\tfrac{1}{2}(\theta_{UB}+\theta_L) \quad (13)$$

where, $\theta_C$: average temperature of the center portion in the width direction of the steel sheet 19 at the completion of the ejection of cooling water 25;

$\theta_E$: average temperature of the side edge portion in the width direction of the steel sheet 19 at the completion of the ejection of cooling water 25;

$\theta_A$: average temperature of the lowest-temperature portion in the width direction of the steel sheet 19 at the completion of the ejection of cooling water 25;

$\theta_B$: average temperature of the highest-temperature portion in the width direction of the steel sheet 19 at the completion of the ejection of cooling water 25.

Figure 11:
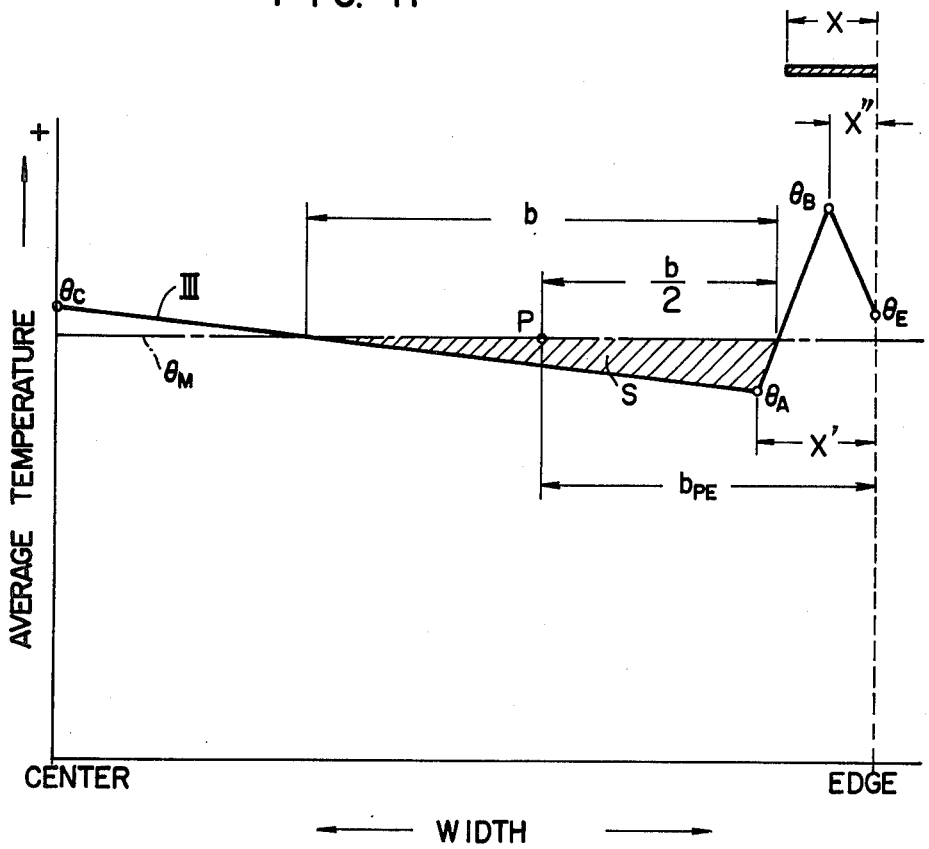
FIG. 11 is a drawing illustrating an example of calculated result of an average temperature distribution and an average temperature of a steel sheet in the width direction of the steel sheet at the completion of the ejection of cooling water.

An example of thus obtained result of calculation is shown in FIG. 11. In FIG. 11, "III" represents the average temperature distribution in the width direction of the steel sheet 19.

d. Then, calculating the average temperature, "$\theta_M$", of the steel sheet 19 at the completion of the ejection of cooling water, on the basis of the result of calculation obtained in c. above. An example of thus obtained result of calculation is shown in FIG. 11.

e. Then, repeating the calculations a. to d. above by changing the provisional shielding width "X" so as to minimize the ratio , "S/$b_{PE}$", of the region "S" of the average temperature distribution "III" lying in a region lower than the average temperature "$\theta_M$" to the distance, "$b_{PE}$", between the center point "P" of the region "S" (i.e., the center point of the total length "b" of the region "S") and the side edge in the width direction of the steel sheet 19, as shown in FIG. 11, thereby determining the provisional shielding width "X" which gives the minimized "S/$b_{PE}$" as the sought shielding width.

With the use of the apparatus 26 for cooling a steel sheet of the present invention, which has the construction as described above, the steel sheet 19 immediately after the completion of hot rolling is cooled as follows:

1. The steel sheet 19 immediately after the completion of hot rolling travels on the table 1*a* as shown in FIG. 2(*b*) and is received in the cooling apparatus 26 at the position (I). Shielding means 22 are arranged above the both side edge portions of the upper surface in the width direction of the steel sheet 19 received in the cooling apparatus 26. The position of the shielding means 22 in the width direction of the steel sheet 19, i.e., the shielding width, is determined on the basis of the width and the thickness of the steel sheet 19, the temperature and the flow rate per unit area of cooling water 25 ejected onto the upper and the lower surfaces of the steel sheet 19, the period of time from start to completion of the ejection of cooling water 25, and the temperature distribution in the width direction of the steel sheet 19 immediately before the start of the ejection of cooling water 25.
2. While the steel sheet 19 thus received in the cooling apparatus 26 travels in the cooling apparatus 26 from the position (I) to (II) as shown in FIG. 2(*b*), cooling water 25 is ejected from the cooling nozzle units 20 and 21 onto the upper and the lower surfaces of the steel sheet 19, and while the steel sheet 19 travels from the position (I) to (II), the both side edge portions of the upper surface in the width direction of the steel sheet 19 are shielded by the shielding means 22 from cooling water ejected from the upper cooling nozzle units 20. The steel sheet 19 is thus cooled appropriately.

Now, examples of the present invention are described below:

EXAMPLE 1

Figure 12:
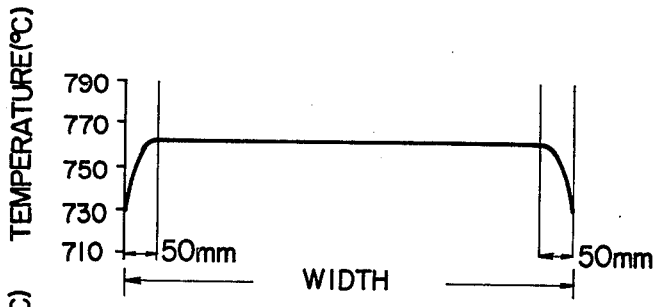
FIG. 12(*a*) is a drawing illustrating an example of an average temperature distribution in the width direction of a steel sheet immediately before the start of the ejection of cooling water.
Figure 12:
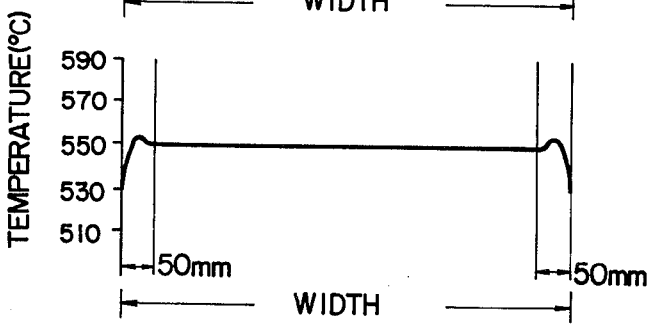
Figure 12:
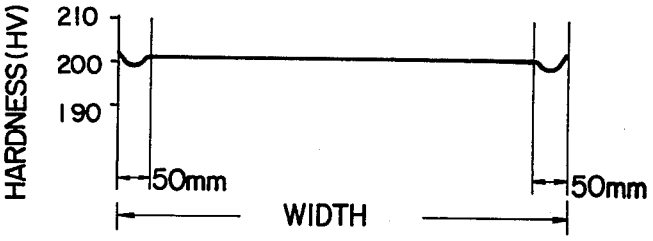

1. A steel sheet 19 immediately after the completion of hot rolling, which has a width of 2,800 mm, a thickness of 20 mm and a length of 25,000 mm, was received in the cooling apparatus 26 at the position (I). The steel sheet 19 immediately before the start of the ejection of cooling water 25 had an average temperature of 770° C. FIG. 12(*a*) shows the average temperature distribution in the width direction of the steel sheet 19 at the longitudinal center thereof immediately before the start of the ejection of cooling water 25. A shielding width of 25 mm was used.

2. Then, while the steel sheet 19 was travelled in the cooling apparatus 26 from the position (I) to the position (II) in 23 seconds, cooling water 25 was ejected from the cooling nozzle units 20 and 21 onto the upper and the lower surfaces of the steel sheet 19 under conditions including a water temperature of 25° C., and a flow rate per unit area of 14 tons/m$^2$.hr for the upper surface of the steel sheet 19 and 28 tons/m$^2$.hr for the lower surface of the steel sheet 19.

The steel sheet 19 showed an average temperature of 550° C. at the completion of the ejection of cooling water 25. FIG. 12(*b*) shows the average temperature distribution in the width direction of the steel sheet 19 at the longitudinal center thereof at the completion of the ejection of cooling water 25. FIG. 12(*c*) shows the average surface hardness distribution in the width direction of the steel sheet 19 at the longitudinal center thereof after spontaneous cooling.

EXAMPLE 2

Figure 13A:
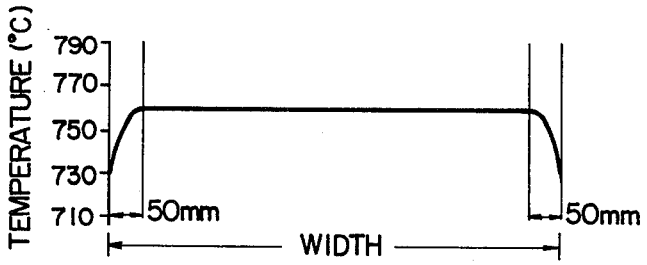
FIG. 13(*a*) is a drawing illustrating an example of an average temperature distribution in the width direction of a steel sheet immediately before the start of the ejection of cooling water.
Figure 13B:
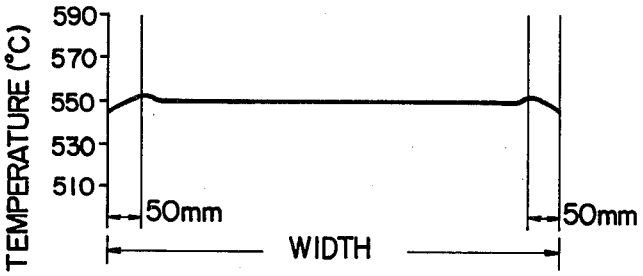
Figure 13C:
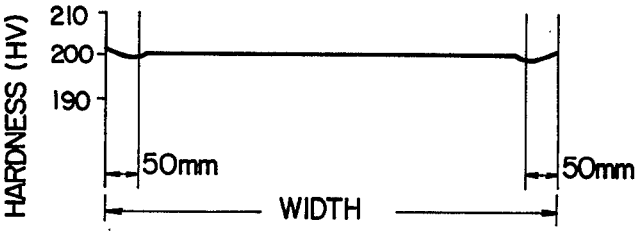

1. A steel sheet 19 immediately after the completion of hot rolling, which has a width of 3,200 mm, a thickness of 20 mm and a length of 25,000 mm, was received in the cooling apparatus 26 at the position (I). The steel 19 immediately before the start of the ejection of cooling water 25 had an average temperature of 760° C. FIG. 13(*a*) shows the average temperature distribution in the width direction of the steel sheet 19 at the longitudinal center thereof immediately before the start of the ejection of cooling water 25. A shielding width of 50 mm was used.
2. Then, while the steel sheet 19 was travelled in the cooling apparatus 26 from the position (I) to the position (II) in 46 seconds, cooling water 25 was ejected from the cooling nozzle units 20 and 21 onto the upper and the lower surfaces of the steel sheet 19 under conditions including a water temperature of 25° C., and a flow rate per unit area of 5.3 tons/m$^2$.hr for the upper surface of the steel sheet 19 and 10.6 tons/m$^2$.hr for the lower surface of the steel sheet 19.

The steel sheet 19 showed an average temperature of 550° C. at the completion of the ejection of cooling water 25. FIG. 13(*b*) shows the average temperature distribution in the width direction of the steel sheet 19 at the longitudinal center thereof at the completion of the ejection of cooling water 25. FIG. 13(*c*) shows the average surface hardness distribution in the width direction of the steel sheet 19 at the longitudinal center thereof after spontaneous cooling.

As is clear from the Examples 1 and 2 mentioned above, the temperature distribution in the width direction of the steel sheet 19 at the completion of the ejection of cooling water 25 is substantially uniform, and the hardness distribution in the width direction of the steel sheet 19 after spontaneous cooling is also substantially uniform.

According to the present invention, as described above in detail, it is possible to achieve a uniform temperature distribution in the width direction of a steel sheet at the completion of the ejection of cooling water. It is therefore possible to obtain a steel sheet with, for example, uniform mechanical properties in the width direction thereof and a satisfactory shape in terms of flatness.

What is claimed is:

1. In a method for cooling a steel sheet, which comprises:

ejecting cooling water onto a steel sheet laid horizontally from above and from below said steel sheet immediately after the completion of hot rolling to cool said steel sheet;

the improvement characterized by:

shielding each of the both side edge portions of the upper surface in the width direction of said steel sheet from said ejected cooling water by a shielding means movable in the width direction of said steel sheet so that the temperature distribution in the width direction of said steel sheet becomes uniform at the completion of the ejection of cooling water; and, determining a shielding width of each of said both side edge portions of said steel sheet, which is shielded from said ejected cooling water, on the basis of the width and the thickness of said steel sheet, the temperature and the flow rate per unit area of cooling water ejected onto the upper and the lower surfaces of said steel sheet, the period of time from start to completion of the ejection of cooling water, and the temperature distribution in the width direction of said steel sheet immediately before the start of the ejection of cooling water.

2. The method as claimed in claim 1, wherein:

said shielding width is determined, prior to the start of the ejection of cooling water, by:

a. calculating an average thermal conductivity distribution of each of the upper and the lower surfaces in the width direction of said steel sheet during the period of time from start to completion of the ejection of cooling water, on the basis of the width of said steel sheet, the flow rate per unit area of cooling water ejected onto the upper and the lower surfaces of said steel sheet, and a provisional shielding width;

b. calculating a temperature distribution of each of the upper and the lower surfaces in the width direction of said steel sheet at the completion of the ejection of cooling water, on the basis of said average thermal conductivity distribution thus obtained, the temperature distribution of each of the upper and the lower surfaces in the width direction of said steel sheet immediately before the start of the ejection of cooling water, the temperature of cooling water, the period of time from start to completion of the ejection of cooling water, and the thickness of said steel sheet;

c. calculating an average temperature distribution in the width direction of said steel sheet at the completion of the ejection of cooling water, on the basis of said temperature distribution thus obtained of said steel sheet at the completion of the ejection of cooling water;

d. calculating an average temperature of said steel sheet at the completion of the ejection of cooling water, on the basis of said average temperature distribution thus obtained; and, e. repeating said calculations a to d by changing said provisional shielding width so that the ratio, "$S/b_{PE}$", of the region of said average temperature distribution (S) lying in a region lower than said average temperature to the distance ($b_{PE}$) between the center of said region (S) and the side edge in the width direction of said steel sheet is minimized; thereby determining said provisional shielding width which gives the minimized "S/$b_{PE}$" as said shielding width.

3. In an apparatus for cooling a hot rolled steel sheet, which comprises means for ejecting cooling water onto a steel sheet laid horizontally, from above and from below said steel sheet, immediately after the completion of hot rolling to cool said steel sheet;

the improvement comprising:

shielding means for shielding each of the both side edge portions of the upper surface in the width direction of said steel sheet from said ejected cooling water, said shielding means being movable in the width direction of said steel sheet so that the temperature distribution in the width direction of said steel sheet becomes uniform at the completion of the ejection of cooling water; and, means for determining a shielding width of each of said both side edge portions of said steel sheet, which is shielded from said ejected cooling water, on the basis of the width and the thickness of said steel sheet, the temperature and the flow rate per unit area of cooling water ejected onto the upper and the lower surfaces of said steel sheet, the period of time from start to completion of the ejection of cooling water, and the temperature distribution in the width direction of said steel sheet immediately before the start of the ejection of cooling water.

4. The apparatus as claimed in claim 3, wherein:

said means for determining said shielding width, prior to the start of the ejection of cooling water, comprises:

a. means for calculating an average thermal conductivity distribution of each of the upper and the lower surfaces in the width direction of said steel sheet during the period of time from start to completion of the ejection of cooling water, on the basis of the width of said steel sheet, the flow rate per unit area of cooling water ejected onto the upper and the lower surfaces of said steel sheet, and a provisional shielding width;

b. means for calculating a temperature distribution of each of the upper and the lower surfaces in the width direction of said steel sheet at the completion of the ejection of cooling water, on the basis of said average thermal conductivity distribution thus obtained, the temperature distribution of each of the upper and the lower surfaces in the width direction of said steel sheet immediately before the start of the ejection of cooling water, the temperature of cooling water, the period of time from start to completion of the ejection of cooling water, and the thickness of said steel sheet;

c. means for calculating an average temperature distribution in the width direction of said steel sheet at the completion of the ejection of cooling water, on the basis of said temperature distribution thus obtained of said steel sheet at the completion of the ejection of cooling water;

d. means for calculating an average temperature of said steel sheet at the completion of the ejection of cooling water, on the basis of said average temperature distribution thus obtained; and e. means for causing repeating said calculations a to d by changing said provisional shielding width so that the ratio "S/$b_{PE}$", of the region of said average temperature distribution (S) lying in a region lower than said average temperature to the distance ($b_{PE}$) between the center of said region (S) and the side edge in the width direction of said steel sheet is minimized; thereby determining said provisional shielding width which gives the minimized "S/$b_{PE}$" as said shielding width.

5. The apparatus as claimed in claim 3 or 4, wherein:

the bottom of each of said shielding means downwardly inclines from the center of said steel sheet toward the side edge in the width direction thereof.

6. The apparatus as claimed in claim 3 or 4, wherein:

said means for ejecting cooling water onto said steel sheet comprises a plurality of upper cooling nozzle units for ejecting cooling water onto the upper surface of said steel sheet and a plurality of lower cooling nozzle units for ejecting cooling water onto the lower surface of said steel sheet, said cooling nozzle units being respectively arranged at prescribed intervals in the longitudinal direction of said steel sheet, above and below said steel sheet, each of said upper and lower cooling nozzle units having a length substantially equal to the width of said steel sheet, and each of said upper and lower cooling nozzle units being arranged in parallel with the width direction of said steel sheet; and each of said shielding means has at least one slit capable of being opened and closed, and said at least one slit is adapted, when opened, to allow passage of cooling water from at least one of said plurality of upper cooling nozzle units toward said steel sheet.

7. The apparatus as claimed in claim 3 or 4, wherein:

said means for ejecting cooling water onto said steel sheet comprises a plurality of upper cooling nozzle units for ejecting cooling water onto the upper surface of said steel sheet and a plurality of lower cooling nozzle units for ejecting cooling water onto the lower surface of said steel sheet, said cooling nozzle units being respectively arranged at prescribed intervals in the longitudinal direction of said steel sheet, above and below said steel sheet, each of said upper and lower cooling nozzle units having a length substantially equal to the width of said steel sheet, and each of said upper and lower cooling nozzle units being arranged in parallel with the width direction of said steel sheet; and said shielding means comprises a plurality of shielding units arranged for each of said plurality of upper cooling nozzle units.

8. The apparatus as claimed in claim 6, wherein:

said shielding means comprises a plurality of shielding units arranged for each of said plurality of upper cooling nozzle units.

9. The apparatus as claimed in claim 6, wherein:

the bottom of each of said shielding means downwardly inclines from the center of said steel sheet toward the side edge in the width direction thereof.

10. The apparatus as claimed in claim 7, wherein:

the bottom of each of said shielding means downwardly inclines from the center of said steel sheet toward the side edge in the width direction thereof.

11. The apparatus as claimed in claim 8, wherein:

the bottom of each of said shielding means downwardly inclines from the center of said steel sheet toward the side edge in the width direction thereof.

* * * * *